US005598752A

United States Patent [19]

Daniels et al.

[11] Patent Number: 5,598,752

[45] Date of Patent: Feb. 4, 1997

[54] RING PLIER WITH TORQUE WRENCH FITTING

[75] Inventors: George G. Daniels, Orlando, Fla.; Robert D. Gracey, Jr., Seattle, Wash.

[73] Assignee: Daniels Manufacturing Corporation, Orlando, Fla.

[21] Appl. No.: 515,038

[22] Filed: Aug. 14, 1995

[51] Int. Cl.[6] ..... B25B 7/12

[52] U.S. Cl. ..... 81/381; 81/90.3; 81/462

[58] Field of Search ..... 81/381, 383, 90.1, 81/90.2, 90.3, 90.4, 90.6, 462

[56] References Cited

U.S. PATENT DOCUMENTS

| | | | |
|---|---|---|---|
| 590,710 | 9/1897 | Sheppard et al. | 81/90.3 |
| 699,803 | 5/1902 | Monehan et al. . | |
| 919,599 | 4/1909 | Lafferty | 81/90.3 |
| 934,332 | 9/1909 | Mills | 81/90.3 |
| 1,456,480 | 5/1923 | Becker | 81/383 |
| 1,536,011 | 4/1925 | Jones et al. | 81/90.4 |
| 1,635,031 | 7/1927 | Champion | 81/90.3 |
| 1,766,778 | 6/1930 | Deluca | 81/90.2 |
| 1,797,106 | 3/1931 | Sweeney . | |
| 2,009,774 | 7/1935 | Herlihy et al. | 81/3.1 |
| 2,376,492 | 5/1945 | Kis | 188/77 |
| 2,431,550 | 11/1947 | Gary | 81/3.3 |
| 2,505,859 | 5/1950 | Jockisch | 81/15.1 |
| 3,389,622 | 6/1968 | Flugel | 81/3.1 |
| 3,862,776 | 1/1975 | Sims et al. | 294/104 |

*Primary Examiner*—Bruce M. Kisliuk
*Assistant Examiner*—Joni B. Danganan
*Attorney, Agent, or Firm*—James H. Beusse

[57] ABSTRACT

A torque-latch ring plier system includes a ring plier having a pair of opposed arms with opposed semi-circular segments forming an annular receptacle. A connecting link joins the pair of arms at the annular receptacle for pivotable movement. A lever is rotatably mounted to one of the arms at about its midpoint and is rotatable to engage a reaction device on the other arm for urging the arms to pivot about the link and close the opposed segments. A coupler is associated with the lever to enable a torque wrench to be connected such that operation of the torque wrench is effective to operate the pliers and establish a selected torque at the opposed segments. The system further includes a tilting bench plate for releasably holding a device to be tightened for angularly positioning the device for ease of access.

10 Claims, 2 Drawing Sheets

RING PLIER WITH TORQUE WRENCH FITTING

BACKGROUND OF THE INVENTION

The present invention relates to an apparatus for applying a specified torque to a threaded backshell of a multipin electrical connector.

Electrical connectors used in aircraft and various types of military vehicles are generally environmentally sealed to prevent moisture incursion. Such connectors are of the type specified in military standards such as, for example, MIL-C-26482, -24308, -26500, -38999 or -5015 as well as numerous other military and industrial specs. In general, these connectors are multipin connectors in which the pins are releasably held in place in the connectors and in which an elastomer material fills the connector around at least a portion of the pins and the electrical wiring connected to the pins. The pins may be soldered or crimped to an electrical wire or cable and are inserted into the connector from the rear side by pushing the pins through preformed holes in the elastomer insert in the connector. The connectors include an outer metal housing with a keyed front section for mating engagement with another connector. A captured twist-lock member couples the two mating connectors. The back part of the housing is threaded for receiving a backshell. The backshell may include an extension for fastening about the wires exiting the rear of the connector for strain relief.

In assembling the backshell to the connector, the connector housing is coupled to a fixture which holds the housing in a fixed position. The backshell is then threaded onto the back of the connector and tightened with ring pliers. Because these connectors are commonly used in areas subject to significant and continuous vibration, the backshell must be tightened onto the connector housing with a specified torque to prevent loosening. One method used to measure applied torque is to attach a torque wrench to the fixture and use a coupling between the connector and wrench. As the backshell is tightened, the amount of torque is visible on the torque wrench.

One problem with the prior art system using ring pliers is that it is difficult for an operator to hold the handles of the pliers closed with sufficient force to keep a good grip on the connector backshell while at the same time attempting to turn the backshell with the pliers in order to develop the required holding torque. Still further, prior systems did not provide a method for easily determining when the specified torque was achieved such as by an audible click of a torque wrench.

SUMMARY OF THE INVENTION

Among the several objects of the present invention may be noted the provision of an improved ring plier with a torque wrench fitting; the provision of an improved ring plier system including a bench mounted apparatus for supporting a connector in position for use of the inventive ring pliers; and the provision of a system which allows one hand operation of the tightening function of the ring pliers.

In an illustrative form, the present invention is illustrated as a torque latch ring plier system formed from a pair of ring pliers having opposed semicircular segments adjacent a first end forming an annular receptacle for fitting about a ring to be tightened on an electrical connector. A connecting link joins the two arms at the first end so that the arms are pivotable in a direction to tighten about the ring. A lever is rotatably or pivotally mounted about approximately a midpoint of one of the arms of the ring pliers and adapted to engage a pin extending from the other of the arms of the ring pliers on a side adjacent the annular receptacle but generally opposite the connecting link. The lever includes a receptacle at one end adapted for receiving the square drive from a conventional torque wrench. The lever is so arranged that when the torque wrench is placed into the receptacle, the handle of the torque wrench extends generally parallel to the direction of the arms of the pliers. Pressure placed on the torque wrench will cause the lever to pivot about its center point against the pin protruding from the opposite arm and tighten the pliers about a ring placed in the annular receptacle. Additional force on the torque wrench results in both tightening of the pliers and rotation of the pliers to turn the ring. The system further includes a table mounting arrangement including a bench plate having a tilting section for holding the connector in a position for tightening the ring. The bench plate has a U-shaped front section designed to fit over the lip of a work bench and a pair of integral clamps for releasably clamping the plate to the table. A portion of the plate is tiltable to different selected angles to allow the connector to be positioned on the plate at a convenient angular orientation. The plate includes integral fittings for receiving an adaptor tool for connecting the plate to different size connectors. The flat part of the plate may include other pegs adapted specifically to store different sizes of adaptor tools.

BRIEF DESCRIPTION OF THE DRAWINGS

For a better understanding of the present invention, reference may be had to the following detailed description taken in conjunction with the accompanying drawings in which.

DETAILED DESCRIPTION OF THE INVENTION

Figure 1:
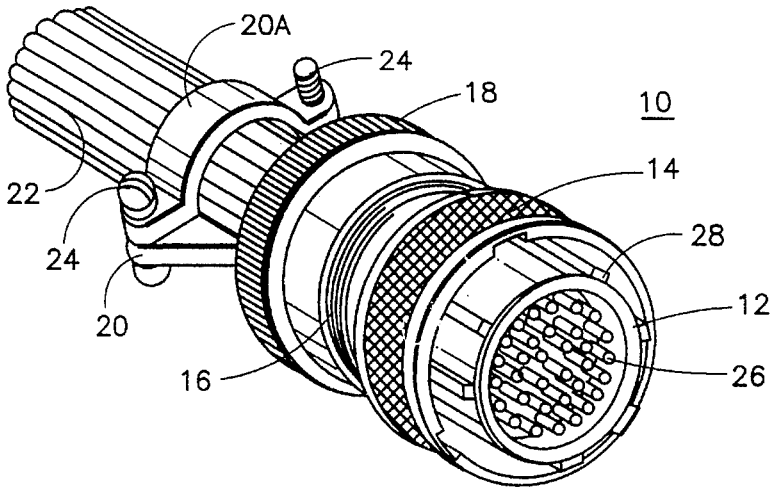
FIG. 1 PRIOR ART
FIG. 1 is a perspective view of a typical mil spec type connector with which the present invention may be used.

Turning first to FIG. 1, there is shown a perspective view of a typical mil spec type multipin connector 10 having an outer metal housing 12 and a rotatable locking ring 14. The rear portion of the housing 12 is threaded as shown at 16 for receiving an internally threaded backshell member 18. The backshell member 18 may include a strain relief 20 having at least a portion of the strain relief formed integrally with the backshell member 18. The strain relief 20 may include a clamp portion **20*a* adapted for clamping a plurality of wires 22 by means of threaded fasteners 24. Each of the wires 22 connects to a respective one of the pins 26 visible in the front portion of the connector housing 12. The outer circumference of the front portion of the housing 12 includes a plurality of raised areas 28 which act as keys for precisely aligning the connector 10 with a mating connector so that the pins 26** are connected to proper ones of the pins in the mating connector.

The keyed or raised areas 28 provide a convenient means for fixedly holding the connector 12 to enable the backshell member 18 to be tightened onto the connector to a specified torque.

Figure 2:
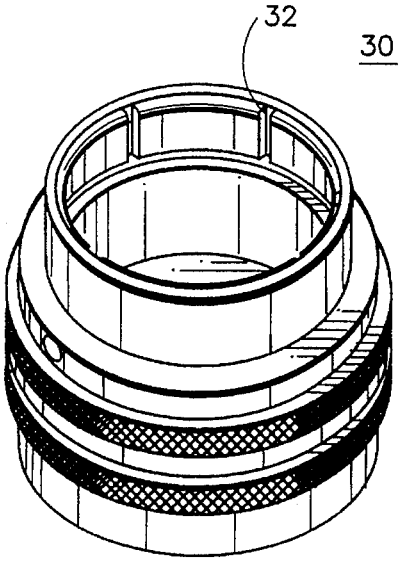
FIG. 2 PRIOR ART
FIG. 2 is a perspective view of an adaptor tool for use in holding the connector of FIG. 1.
Figure 3:
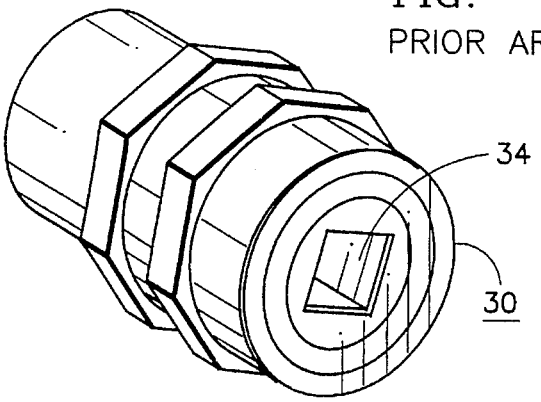
FIG. 3 PRIOR ART
FIG. 3 is a bottom perspective view of the adaptor tool of FIG. 2.

Referring to FIG. 2 and FIG. 3, there is shown an adaptor tool 30 specifically adapted for mating with the connector 10 and enabling the connector to be held in a fixed or non-rotatable position. The adaptor tool 30 includes a plurality of internal slots 32 at one end which are positioned t0 engage the keyed or raised areas 28 on the connector 10. The bottom of the adaptor tool 30 includes a square receptacle 34 sized to fit a conventional square drive wrench. The adaptor tool 30 may be in different sizes and the receptacle 34 may be sized to fit a corresponding wrench such as a ⅜" or ¼" drive wrench.

Figure 4:
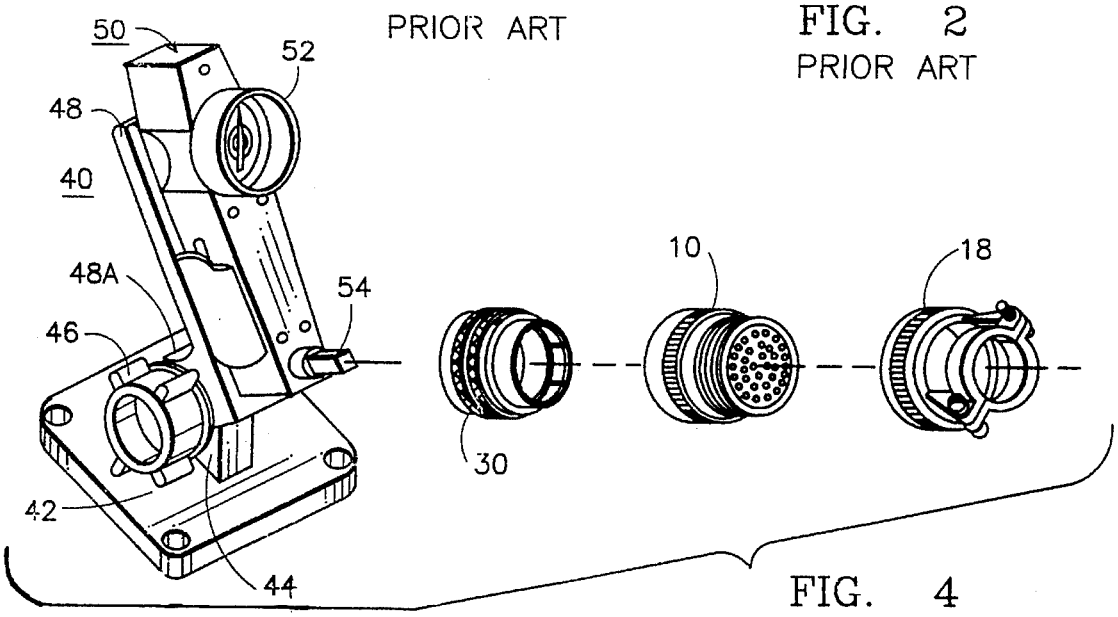
FIG. 4 PRIOR ART
FIG. 4 illustrates a prior art support for a torque wrench used in attaching a backshell to a connector in the form shown in FIG. 1.

Turning now to FIG. 4, there is shown one assembly and method for tightening the backshell member 18 onto a connector 10 using the adaptor 30. A bench mounted apparatus 40 includes a flat base plate 42 and a centrally located upright lug 44. The lug 44 may include a threaded aperture for receiving a bolt having a large handle end 46. A pivotable support 48 is attached to the lug 44 by means of the bolt passing through a hole in a flange 48*a* depending from one corner of the support 48. A torque wrench 50 is attached to the support plate 48. The wrench 50 has a dial readout 52 which faces from the wrench in the same direction as the drive 54. The support plate 48 and the attached wrench 50 can be positioned at different angles by adjusting the handle 46 attached to the locking screw. The adaptor 30 fits on the drive 54 by pressing the adaptor 30 onto the drive such that the receptacle 34 fits onto the drive 54° The connector shell is then placed in the adaptor 30 by aligning the keyed bars 28 with the receptacles 32 in the adaptor 30. The backsbell member 18 is then threaded on to the back of the connector 10 and tightening is achieved by gripping the backshell 18 with an appropriate pair of backshell pliers and tightening the backshell on to the connector 10.

Figure 5:
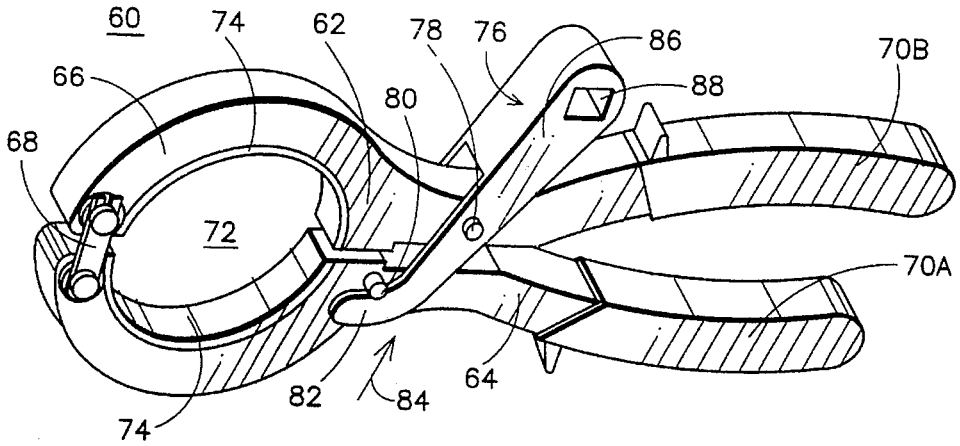
FIG. 5 is a perspective view of a ring plier in accordance with the present invention.

Turning now to FIG. 5, there is shown an improved pair of backshell ring pliers 60 in accordance with the present invention. The pliers 60 include mirror image arm members 62 and 64. Each of the arm members 62 and 64 terminate in an end 66 and a pair of semicircular segments which, when brought together, form a circular clamp for fitting about a ring such as the ring 18 on connector 10. The ends of the arms 62 and 64 at end 66 are connected by a connecting link 68 which is pivotably attached to each of the arms 62 and 64. The arms 62 and 64 have opposite handle ends 70 which can be squeezed to allow the arms to pivot about the connecting link 68 to compress against a ring placed within a circular area 72 at end 66. The inner portions of the arm members 62 and 64 forming the circular ring grasping area 72 is preferably provided with an inner soft layer of rubber or other synthetic rubber-like material indicated at 74 which enables the arms to grasp the serrated outer edges of the ring 18 without damaging the connector backshell. The material 74 also allows the pliers to adapt for minor deviations in size or shape of ring 18.

As previously described, it is difficult for an operator to squeeze the handles 70*a* and 70*b* towards each other so as to compress the end 66 about a larger backshell connector with sufficient force to hold the connector and at the same time turn the connector to the prescribed torque for that connector. The torque settings are generally fairly high to insure that the backshell connector does not come loose during vibration which may be encountered in various applications such as when the connectors 10 are used in aircraft. In order to overcome this problem, applicant attaches a lever arm 76 to the handle 62 by means of a pivot pin indicated at 78. Although illustrated only as a pin, it will be appreciated that pin 78 could be replaced by other types of devices, including a movable or slidable device, since the purpose of pin 78 is merely to provide a pivot or fulcrum for lever arm 76. A second pin 80 is attached to the opposite plier arm 64 and displaced towards the opening 72 from the first pivot pin 78. As with pin 78, pin 80 could be replaced with some other device suitable for providing a bearing or reaction dec,ice for lever arm 76. The lever arm 76 is shaped at one end 82 so that it curves towards the pin 80 in such, a fashion as to create a force in the direction indicated by arrow 84 which is primarily in a direction to close the arm 64 towards the arm 62. An opposite end 86 of the lever 76 is provided with a coupler such as receptacle 88 sized to fit a conventional ½", ⅜" or ¼" drive on a torque wrench. The receptacle 88 is aligned such that when the arm 64 and 66 are closed sufficiently to engage a ring 18 placed in the opening 72, and with the lever end 82 in contact with the pin 80, a torque wrench drive can be inserted in the opening 88 such that the handle of the torque wrench will extend substantially parallel to a direction of the handles 70*a* and 70*b*.

From an observation of FIG. 5, it will be seen that when the torque wrench such as the torque wrench 50 of FIG. 4 is coupled to lever arm 88, the torque wrench can be operated to cause the pliers 60 to tighten about a ring 18 placed within the opening 72 and simultaneously cause the ring to be rotated by operation of the torque wrench to drive the pliers 60 in a rotatable motion. Use of the torque wrench in this manner has two distinct advantages. One advantage is that the torque wrench can be operated with only one hand and does not require that the operator simultaneously squeeze the handle 70*a* and 70*b* in order to generate the force necessary to clamp the pliers 60 onto the backshell ring 18. A second advantage is that the torque wrench provides a mechanical advantage due to its increased length over the length of the handles 70*a* and 70*b* and thus eases or reduces the amount of force that the operator must apply in torquing the backshell member 18 to a desired torque. Since there is also a displacement between the point at which the torque is applied, i.e., torque being applied to the opening 88 at the end of lever arm 76, the actual reading on the torque wrench will have to be adjusted for the additional lever arm created between the aperture 88 and the center of the opening 72. However, such adjustment can be made by simple calculation based upon that distance so that a table of values for torquing of the backshell member 18 to a desired value can be established to correspond to the actual desired values of torque.

It will also be seen that in using the improved ring plier 60, that the torque wrench is now moved from the bench position shown in FIG. 4. Accordingly, a different arrangement is provided for supporting the connector 10 for attachment of the backshell member 18.

Figure 6:
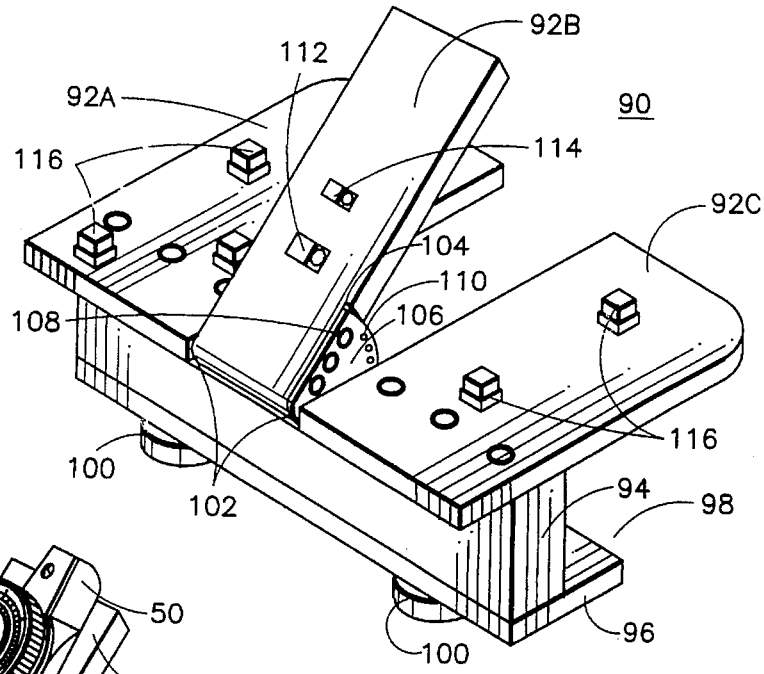
FIG. 6 is a perspective view of a connector adaptor holding platform in accordance with the present invention.

Referring now to FIG. 6, there is shown an improved tilting bench plate for use with the torque latch ring plier of FIG. 5. The tilting bench plate 90 of FIG. 6 includes a three-section upper plate member 92 comprising a left section 92*a*, a middle tiltable section 92*b* and a right fixed section 92*c*. The left and right plates 92*a* and 92*c* are bolted or otherwise attached to a perpendicularly oriented standard 94. Another plate 96 is bolted or otherwise attached to the lower edge of standard 94. The lower plate 96, standard 94 and upper plates 92*a* and 92*c* form a generally U-shaped channel 98. The height of the standard 94 is selected to be approximately equal to the thickness of a standard work bench. Accordingly, the plate 90 can be slid over the edge of a work bench with the upper plates 92*a* and 92*c* lying on top of the work bench and the lower plate 96 fitting under the bottom surface of the work bench. A pair of hand operated threaded fasteners 100 can be seen protruding below the bottom of lower plate 96. These fasteners extend through threaded holes in 96 and are positioned so that when tightened they bear against the bottom surface of a work bench from which the bench plate is positioned so as to hold the bench plate in position on the work bench so that the channel 98 and fasteners 100 operate as an integral clamp for attaching the bench plate to a work bench. The center section 92*b* of the bench plate 90 is pivotably attached at 102 to each of the adjacent fixed plate sections 92*a* and 92*c*. Various means are well known for pivotally mounting the plates together including forming mating holes in each of the adjacent edges at the corners 102 and connecting the three plates by means of pins extending through the mating holes prior to attaching at least one of the plates 92*a* or 92*c* to the standard 94. A slot 104 may be cut in the side of the plate 92*b* for receiving a triangular shaped side plate 106. The plate 106 is bolted at 108 to the plate 92*b*. A plurality of holes 110 are formed along one edge of the plate 106. A spring loaded ball member may be captured in a side of the plate 92*c* and positioned so that the ball will slip into each of the holes 110 as the plate 92*b* is pivoted about points 102. In this manner, the plate 92*b* may be positioned at any desired angle with respect to the side plates 92*a* and 92*c*. Other forms of detents or fastening means may be used to position the plate 92*b* at desired angles.

The plate 92*b* is fitted with square drive elements 112 and 114. These drive elements are the same type of drive elements that are used in commercially available socket drive wrenches. Each of the elements 112 and 114 are sized to fit a different size of the adaptor tools 30 when the adaptor tool is positioned on the drive elements such that the aperture 34 in the adaptor tool fits on to the drive elements 112 and 114. Conventionally, the adaptor tools are provided with either ⅜" or ¼" drive sockets. Accordingly, the drive elements 112 and 114 may be ⅜" and ¼" elements. It will be noted also that stepped storage pegs 116 are attached to the top surface of each of the side plates 92*a* and 92*c*. These stepped storage pegs are provided for storing adaptor tools 30 for different sizes of connectors 10. The stepped pegs allow a ⅜" adaptor tool to be positioned on the lower larger portion of the pegs while an adaptor tool with ¼" drive fits on to the upper smaller portion of the peg. Thus, the pegs are interchangeable for receiving either ⅜" or ¼" drive adaptor tool.

Figure 7:
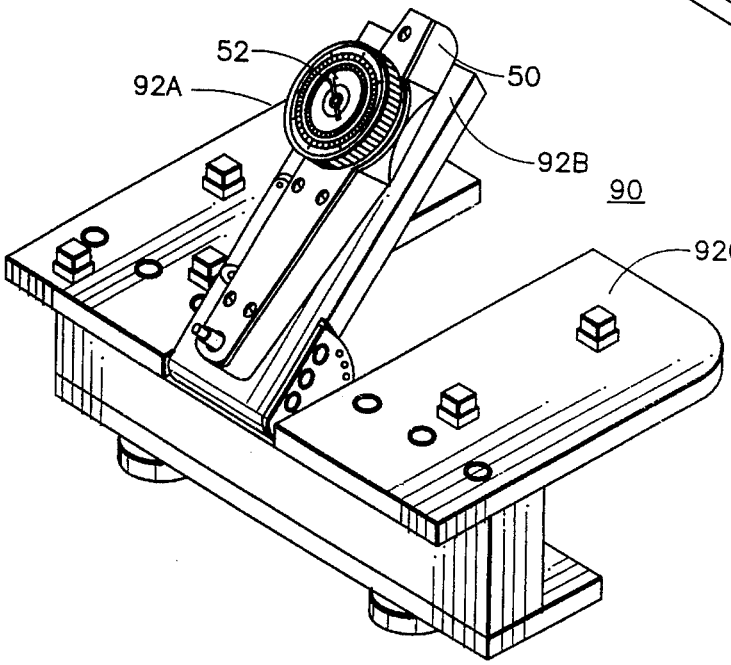
FIG. 7 illustrates the platform of FIG. 6 adapted for direct mounting of a torque wrench.

Referring now to FIG. 7, there is shown a still further embodiment of the present invention in which the bench plate 90 includes a center section 92*b* which is adapted to hold the torque wrench 50 in the same manner as shown in FIG. 4. One advantage of the bench plate of FIG. 7 over the prior apparatus of FIG. 4 is that the bench plate 90 is easily attached to an edge of a conventional work bench. The apparatus of FIG. 4 requires that the plate 42 be bolted to the top of the work bench and is therefore fixed in position. Applicant has found that operators tend to have particular desires as to where the bench plate may be located on their particular work bench. Some operators prefer the work bench on the right hand side while others prefer it on the left hand side° With the apparatus of FIG. 4, the apparatus is fixed in position on a work bench and is not easily moved. With applicant's inventive apparatus, the bench plate can be moved to any desired location on a work bench. In using the bench plate as shown in FIG. 7, the operator can use the improved pliers of FIG. 5 with a longer handle conventional socket drive unit to gain the additional torque needed to tighten the backshell ring 18 to its desired value and at the same time read the exact torque generated on the torque wrench 50. As described above, the socket wrench may be utilized to reduce the amount of effort that must be applied by the operator and therefore ease the job of assembling the backshell member to the connector 10. The advantage of FIG. 7 is that the torque applied to the backshell member can be read directly on the meter 52 without having to make corrections for the increased lever arm between the point at which the socket wrench is coupled to the pliers and the center of the connector 10.

While the invention has now been described in what is considered to be a preferred embodiment, various modifications and improvements will become apparent to those skilled in the art. Accordingly, it is intended that the invention not be limited to the specific disclosed embodiments but be interpreted within the full spirit and scope of the appended claims.

What is claimed is:

1. A torque-latch ring plier system comprising:

a pair of opposed arms each having opposed semi-circular segments adjacent a first end thereof, the opposed segments forming an annular receptacle;

a connecting link joining said pair of arms at the first ends, said arms being pivotable about said link by movement of second ends of said arms distal from said first ends;

a lever rotatably mounted to one of said arms between said first and second ends thereof;

a reaction device on another of said arms for reacting against one end of said lever when said lever is rotated in a first direction for urging said arms to pivot about said link and close said opposed segments; and a coupler for coupling a torque wrench to said lever, operation of said torque wrench being effective to operate the pliers and establishing a selected torque at said opposed segments.

2. The plier system of claim 1 wherein said reaction device comprises a protrusion extending generally perpendicularly from said another of said arms proximate said semi-circular segment thereof.

3. The plier system of claim 2 wherein said lever means is mounted to said one arm at approximately a mid-point between said first and second ends thereof.

4. The plier system of claim 3 wherein said coupler comprises a fitting on another end of said lever opposite said one end, said fitting being adapted for receiving a socket fitting on the torque wrench such that the torque wrench is aligned generally parallel to said plier arms when said arms are substantially closed.

5. The plier system of claim 1 wherein said annular receptacle is adapted for engaging a threaded backshell on a multipin cable connector, the system including an adaptor tool for the connector and a tilting bench plate releasably holding the adaptor tool for angularly positioning the connector for ease of access to the backshell.

6. The plier system of claim 5 wherein said tilting bench plate includes an integral clamp for clamping said plate to a workbench.

7. The plier system of claim 6 wherein said tilting bench plate comprises a fixed plate segment adapted for laying onto an upper surface of the workbench and a pivotable segment adapted for pivoting about an edge of the upper surface of the workbench, said pivotable segment having at least one drive element for the adaptor tool.

8. The plier system of claim 7 wherein said fixed plate segment includes a plurality of mounting pegs for storing additional adaptor tools.

9. The plier system of claim 8 wherein said mounting pegs include a stepped portion for receiving adaptor tools of different drive sizes.

10. A torque plier for association with a torque wrench to measure torque imparted to an object gripped by the torque pliers, the torque pliers comprising:

a pair of pivotally movable arms interconnected with each other and associated with the object for applying the torque thereto in response to a force exerted on said pivotable movable arms, said pivotally movable arms including a pair of opposed grippers for gripping engagement with the object at least upon the exertion of the force on the pivotally movable arms, respectively; and a lever pivotally arranged on one of said pivotally movable arms and pivotally actuated by the other of said pivotally movable arms when the force is exerted on the pivotally movable arms, and said lever including a coupler for receiving the torque wrench to apply a torque to the object while simultaneously applying a gripping force to the object.

* * * * *